US008322086B2

(12) United States Patent
Weber

(10) Patent No.: US 8,322,086 B2
(45) Date of Patent: Dec. 4, 2012

(54) SINGLE CONTAINER TRANSPORTABLE DWELLING UNIT

(76) Inventor: James D Weber, Kennewick, WA (US)

( * ) Notice: Subject to any disclaimer, the term of this patent is extended or adjusted under 35 U.S.C. 154(b) by 534 days.

(21) Appl. No.: 12/462,288

(22) Filed: Aug. 3, 2009

(65) Prior Publication Data

US 2011/0023381 A1 Feb. 3, 2011

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 9/00*** | (2006.01) |
| ***E04H 14/00*** | (2006.01) |

(52) U.S. Cl. ..... 52/79.5; 52/64; 52/67; 52/71; 52/271; 52/309.11; 52/234; 296/183.1

(58) Field of Classification Search ..... 52/64, 66, 52/71, 79.1, 79.5, 270, 271, 309.11, 67, 72, 52/234, 239; 296/183.1, 184.1; 472/3
See application file for complete search history.

(56) References Cited

U.S. PATENT DOCUMENTS

| | | | | |
|---|---|---|---|---|
| 3,254,914 | A | 6/1966 | Steck | |
| 3,983,665 | A | 10/1976 | Burton | |
| 4,075,814 | A * | 2/1978 | Theurer et al. | 52/79.5 |
| 4,083,154 | A | 4/1978 | Klink | |
| 4,534,141 | A | 8/1985 | Fagnoni | |
| 4,891,919 | A | 1/1990 | Palibroda | |
| 4,911,318 | A * | 3/1990 | Bishop | 220/1.5 |
| 4,986,571 | A * | 1/1991 | Godbersen | 280/854 |
| 5,284,266 | A * | 2/1994 | Januel et al. | 220/1.5 |
| 5,317,857 | A | 6/1994 | Allison | |
| 5,950,373 | A | 9/1999 | von Hoff et al. | |
| 6,200,085 | B1 * | 3/2001 | Gee | 414/813 |
| 6,438,903 | B1 | 8/2002 | Weiss | |
| 6,854,218 | B2 | 2/2005 | Weiss | |

FOREIGN PATENT DOCUMENTS

| | | |
|---|---|---|
| JP | 05018008 | 1/1993 |
| JP | 05033395 | 6/1994 |
| KR | 100905492 B1 | 7/2009 |
| WO | WO2009089584 A1 | 7/2009 |

OTHER PUBLICATIONS

The PCT Search Report mailed on Feb. 28, 2011 for PCT Application No. PCT/US10/44115, a counterpart foreign application of U.S. Appl. No. 12/462,288.

* cited by examiner

*Primary Examiner* — William Gilbert
*Assistant Examiner* — Chi Q Nguyen
(74) *Attorney, Agent, or Firm* — Lee & Hayes, PLLC

(57) ABSTRACT

The off-site manufacture and on-site assembly of a prefabricated dwelling unit ("Unit") are described herein. The Unit may be a single stand-alone Unit or an individual Unit within a group of Units such as a duplex or apartment building. The Unit is substantially prefabricated and nests within itself through a configurable design that utilizes a floor framing system. The Unit may also include fold down floor assemblies, moveable walls of 96" height, pre-installed floors and fixtures. The Unit may be configured for a decreased footprint that will fit into a single shipping container along with the other necessary components for completion of the Unit on-site. The Unit may be loaded and unloaded from a single shipping container without substantially limiting the size, shape, or aesthetics of the Unit while being substantially prefabricated.

23 Claims, 9 Drawing Sheets

SINGLE CONTAINER TRANSPORTABLE DWELLING UNIT

BACKGROUND

Field of Invention

This application relates to the off-site manufacture and on-site assembly of prefabricated dwelling units. Prefabricated dwelling units may be single, stand-alone Units, or individual Units within a group of Units such as a duplex, triplex, condominium complex or apartment building.

The construction of a conventional site-built dwelling unit is a multi-step process fraught with various pitfalls. Corruption, delays and damage are all but inevitable in a complex process involving multiple suppliers and trades that must be coordinated chronologically and simultaneously. The necessity to coordinate and work with different suppliers and skilled trades causes difficulty with scheduling, personnel conflicts, communication, and safety. The process can easily become lengthy, costly and inefficient. These multiple trades include but are not limited to: grading, sitework preparation, laying and pouring of foundations, framing, erection of structural walls, door and window cut-outs, roof construction, plumbing installation, electrical wiring, cat-5/network cabling, HVAC installation, alarm installation, laying of floors interior and exterior coverings, and final finishes and trims. These problems are inherent to the conventional site-built process when building locally with workers or other entities one is familiar with, and are magnified when building with workers one is not familiar with, or when building elsewhere than one's primary business location such as out of state or, especially, overseas.

Further, since each step is performed on-site, builders are forced to contend with a number of factors beyond their control. Inclement weather such as rain, snow, wind, heat, typhoons, hurricanes, blizzards, cold and other extremes can slow or halt construction, while ruining stored building materials before they are installed.

Meanwhile, the security of construction equipment and materials must be addressed as thieves or the trades' own workers may often pillage construction sites by stealing valuable tools, equipment, and materials needed for the project.

SUMMARY

The shipping of prefabricated dwelling units may work within existing transportation system constraints such as road widths, bridge heights, and laws which inevitably vary from state to state and country to country. Towing a prefabricated dwelling unit down the road for a local delivery may be ideal over short distances, but this method is impractical for long distance shipment within the United States or overseas. One practical shipping method that is available is the use of existing standardized shipping containers which can be transported by sea, rail, or road to almost any location in the world.

However, the materials and components of an individual prefabricated dwelling unit do not fit within the confines of a standard shipping container in any of its available sizes unless either: a) the design of the prefabricated dwelling unit is severely limited to closely conform to the size of the shipping container resulting in a less desirable dwelling unit with substandard (less than 96") ceiling heights; or alternatively if the amount of prefabrication is greatly reduced to enable more packing flexibility which significantly decreases the purpose of prefabrication.

In light of the foregoing, it would be most advantageous to have a dwelling unit that is not bound by the size, shape, and ceiling height of a standard shipping container, but can still be shipped in a single shipping container while maintaining a high degree of prefabrication. This configuration may maximize many of the advantages of prefabrication over site-built construction while maintaining much of the design flexibility of site-built structures. Moreover, it may minimize the costs and logistical troubles associated with long distance shipping and storage.

This application describes the off-site manufacture and on-site assembly of a prefabricated dwelling unit ("Unit") that may be either a single stand-alone Unit or an individual Unit within a group of Units such as a duplex, condominium or apartment building. The Unit may be substantially prefabricated, having its walls, floors, and fixtures pre-installed. Further, the Unit that is configurable to a smaller size that may reside in a single shipping container along with all necessary components and tools for completion and installation of the prefabricated dwelling. For example, the Unit may fit in a single shipping container by nesting within itself through moveable walls and fold down floors attached to a flush flooring system. The Unit may fully reside in and may be loaded and unloaded from a standard single shipping container without limiting the size, shape, or aesthetics of the Unit. The Unit may include a high degree of prefabrication that requires minimal site-built assembly once delivered to the end user. The following integrated innovations allow a majority of the most time consuming and skill intensive tasks such as floor and wall framing, wiring, plumbing, fixture, and cabinet installation to be prefabricated and preinstalled into a Unit which may fit into a single shipping container, yet will not be limited to the size or shape of the shipping container.

This application describes a unique floor framing system and rollers, each of minimal thickness that maximizes the wall and ceiling heights of a Unit in relation to shipping container height. In one embodiment, the Unit may have a 96" wall height. The Unit may also be configured to be shipped in a standard "High Cube" shipping container. The system may include a floor framing system comprised of metals or other suitably strong materials and a series of rollers, which may be removed from the Unit. These rollers protrude a minimal distance below the floor frame of a Unit. The rollers may permit a Unit to be rolled into or out of a container, or alternatively, rollers may be installed within the container floor protruding a minimum distance above the container floor to allow the same rolling function performed by the rollers when they are attached to the frame. The floor framing systems may further contain integral leveling bolts enabling the Unit to be rapidly leveled once placed on a site-built foundation, and/or integral tie-down devices to permanently secure the Unit in place on its foundation. The Unit may also contain integral foundation supports and/or soil screws enabling placement directly upon native soil as appropriate.

This application describes a Unit with preinstalled 96" (e.g., 8 feet) tall walls. The capability to preinstall the walls means other interior components of the Unit such as cabinetry and bathroom fixtures, which may be installed against and connected into walls, may also be preinstalled.

This application further describes one or more expandable sections consisting of one or more foldable floor section(s) utilizing a unique hinge in this application or other means of allowing the foldable floor section(s) to be rotated into place along with one or more prefabricated, moveable exterior wall section(s). In an embodiment, the desired configuration is achieved by folding the Unit's folding floor section(s) down into place, removing the hinges, and then shifting the moveable wall section(s) into their respective foldable floor section (s) so that multiple sections of the house may reside within each other.

The moveable wall configuration process may include a linear movement of the moveable wall section(s) from the moveable wall section's shipping position on the main floor of a Unit out to a corresponding foldable floor section. The configuration may be further eased by various mechanisms in the design, which reduce the friction of a moveable wall section against the floor, such as small retractable wheels or rollers which may be removable wheels that are affixed to the bottom of a moveable wall section, or via an integrated air bearing system. In one embodiment, the moveable wall section(s) may be prefabricated prior to shipment including interior and exterior finishes so that internal wiring, plumbing, and other systems, once moved into final position, may be connected to corresponding adjacent systems in adjacent, non-moveable portions of a Unit.

The configuration capabilities of the Unit are a significant and unobvious advantage to the prior art as they enable a Unit of larger size and shape to be nested into a single shipping container for storage and shipping. The ability to utilize a single shipping container is advantageous, as a single container is simpler logistically, and substantially more economical than multiple containers.

Remaining components for completion of the Unit may include ceilings and roofs which may be securely stored in the empty shipping container until ready for use, minimizing risks of theft or damage from exposure to inclement weather. The components of the Unit may include prefabrication including panelization to be quickly assembled on-site depending upon the particular design of a Unit. Once the final components have been installed, the empty shipping container may be returned, or may be integrated as an attached or detached garage or other accessory structure to the Unit.

These and other objects and advantages of the present application shall be made apparent from the accompanying drawings and the description thereof.

BRIEF DESCRIPTION OF THE DRAWINGS

The accompanying drawings, which are incorporated in and constitute a part of this specification, illustrate several embodiments of the invention. The general description of the invention given above, and the detail description of the embodiments given below will serve to further explain and clarify the embodiments.

DETAILED DESCRIPTION

Overview

Following is a detailed description of the embodiments described in the application of the invention with reference to the accompanying drawings. The particularity of these drawings and their related description should not be construed as the only embodiments protected by the claims.

Illustrative Nested Structure

Figure 1:
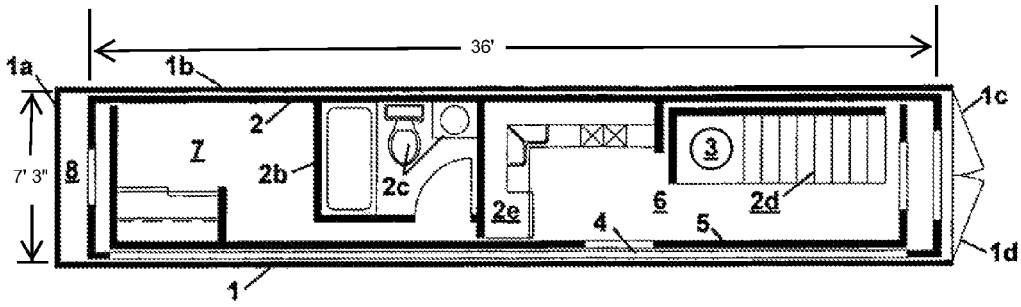
FIG. 1 is an illustration of the Unit loaded into a shipping container.
Figure 4:
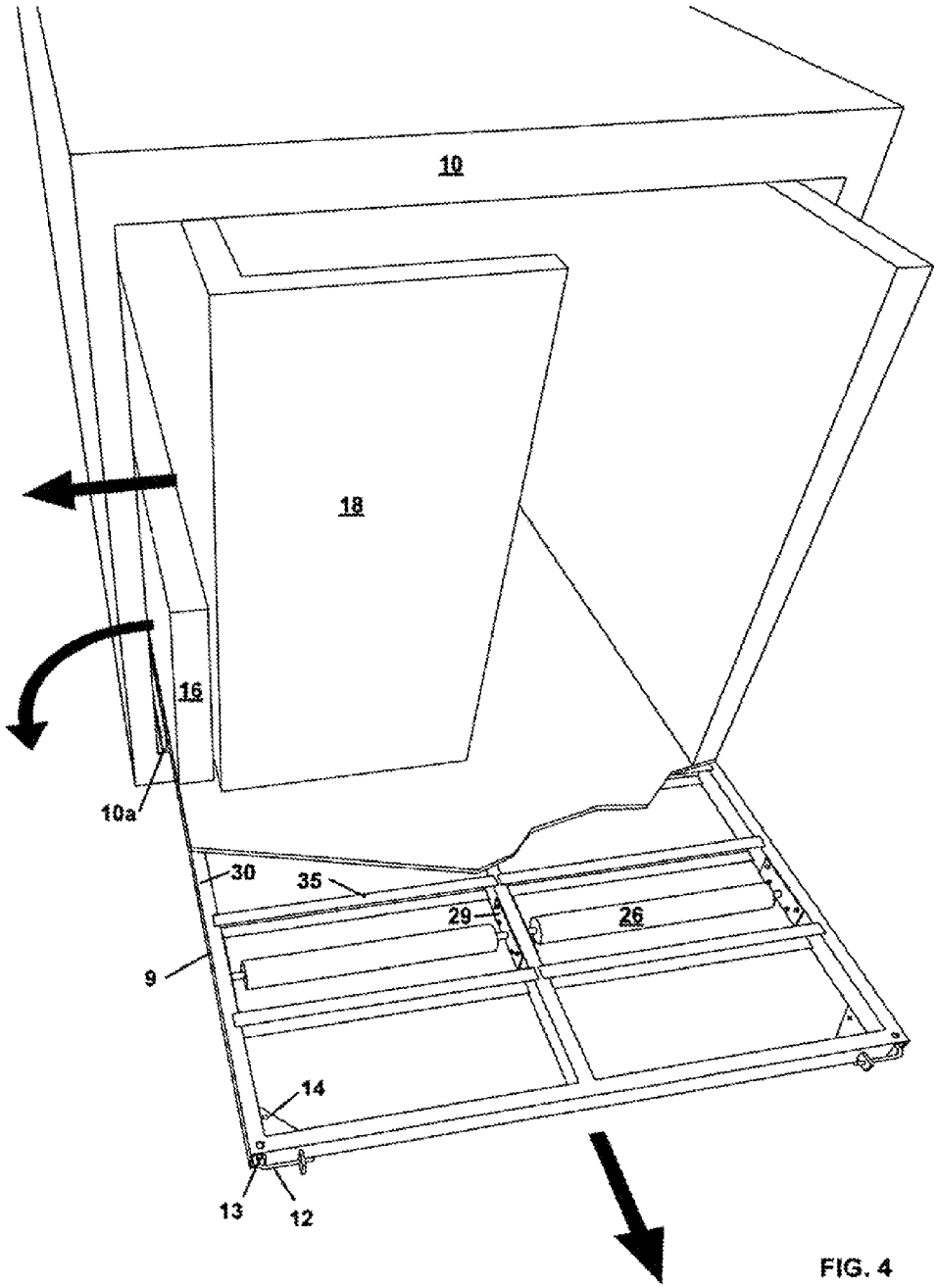
FIG. 4 is an illustration of a Unit being unloaded from a shipping container.

Referring to FIG. 1, numerals 1, 1*a* and 1*b* are the walls of the standard High Cube shipping container. 1*c* and 1*d* are separate wall sections affixed with hinges and a locking mechanism that forms the loading door of the shipping container. The longitudinal fixed walls 2 of the transportable structure may include the bathroom walls 2*b* and bathroom fixtures 2*c*, the bathroom fixtures including bathtub, toilet and vanity. The fixed walls 2 may also include the stairs and supporting structure 2*d* and kitchen cabinets, granite counter tops, and related plumbing and fixtures 2*e*. The fixed walls may be permanently affixed to the floor and frame assembly (reference numeral 9, as seen in FIG. 4). In this embodiment, the fixed wall section 2 may be prefabricated and complete with affixed concrete composite exterior siding, insulation, and interior gypsum wall board. Additionally, the fixed wall 2 may include electrical wiring and plumbing as well as a plurality of windows, one of which may be used as an emergency egress exit for a bedroom. Moreover, the fixed wall section 2 may include an installed electrically energized water heater 3. Also, a hinged floor assembly 4 is shown in the shipping position and is fastened to the moveable wall section 5 which is also shown in its nested shipping position. The moveable wall section 5 may also be prefabricated with similar components as seen in the fixed wall section 2 with the addition of pre-hung exterior doors and the air bearing components illustrated in FIG. 8. Numerals 6, 7, and 8 disclose areas within the fixed wall structure 2 and container 10 where setup and finishing materials may reside. The setup and finishing materials may include additional framing materials, insulation, exterior siding, steel roofing panels, garage door, miscellaneous fasteners, gypsum wall panels, floor decking, floor tile, paints and primers, appliances, and various decorative attachments secured for shipment.

Illustrative Assembled Unit

Figure 2:
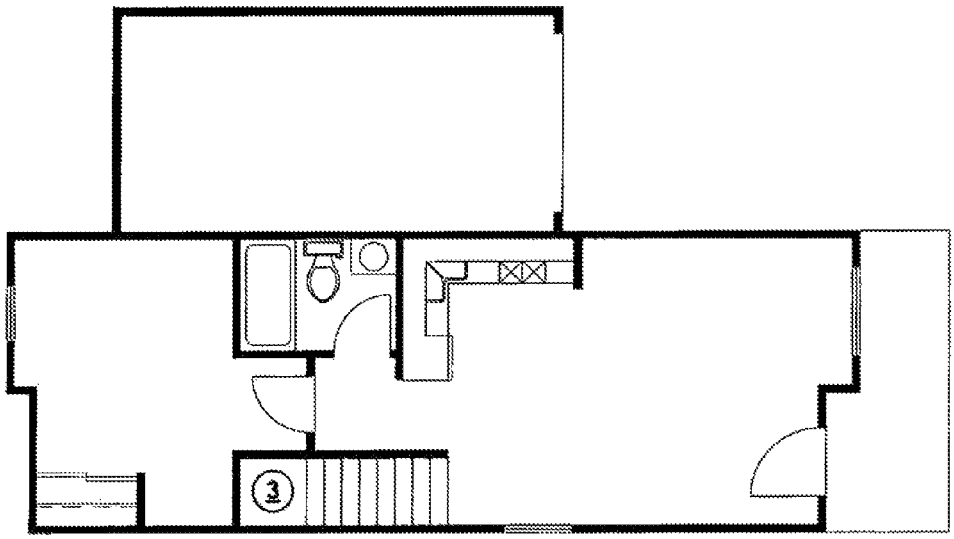
FIG. 2 is an illustration of a 1st story of a completed Unit.

FIG. 2 is an illustration of a top view of the first floor of an assembled Unit. Stairs 3 provide access to a second story of the assembled Unit.

Figure 3:
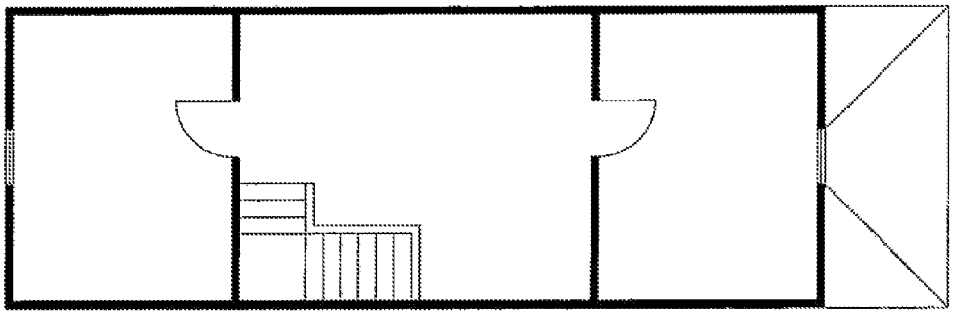
FIG. 3 is an illustration of a 2nd story of a completed Unit.

FIG. 3 is an illustration of the top view of the second floor of an assembled Unit which is accessible from the first floor via the stairs 3.

Illustrative Steel Framework

As shown in FIG. 4, the frame 9, depicted in cutaway view, may include welded steel tubing construction fitted with pressure treated floor decking on top of the frame 9. Additionally, expandable foam insulation may fill the spaces between the steel frame tubes and the fixed wall section 2. The container 10, as shown with the loading doors 1*c* and 1*d* removed for clarity, may be guided by grease lubricated 1"×4" wooden battens, 10*a*. Rollers 26, detailed in FIG. 12, may facilitate loading and unloading of the Unit structure. Further, integral cam locks 12, integral floor leveling device 13, tie down device 14, the hinged assembly 16, the moveable wall section 18, the axle plate 29, the square tube frame assembly 30, and the floor joist 35 will be described below.

Illustrative Deployment from a Shipping Container

Figure 5:
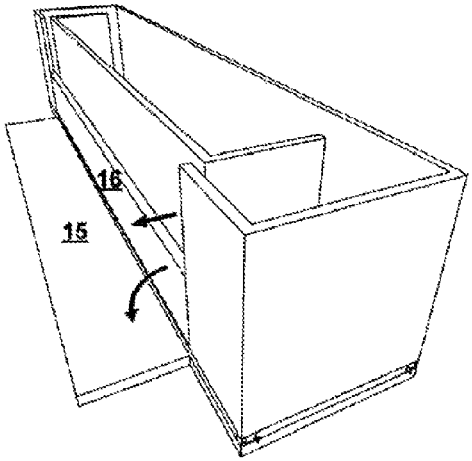
FIG. 5 is an illustration of a Unit unloaded onto a foundation.
Figure 6:
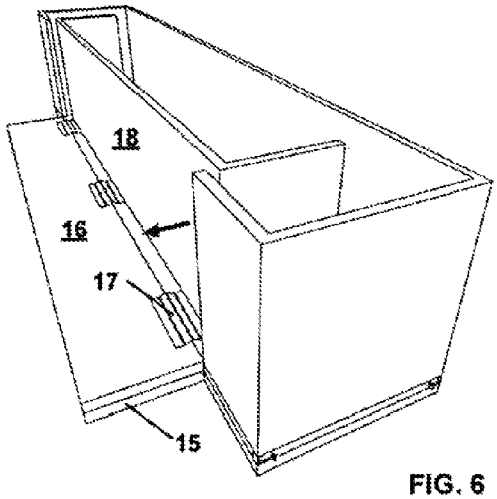
FIG. 6 is an illustration of a foldable floor section in final position.
Figure 7:
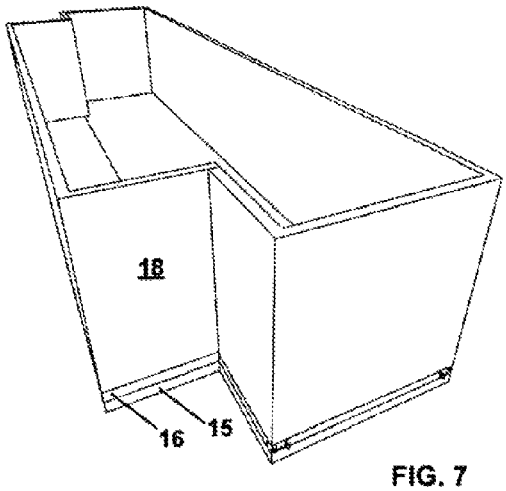
FIG. 7 is an illustration of a moveable wall section in final position.
Figure 8:
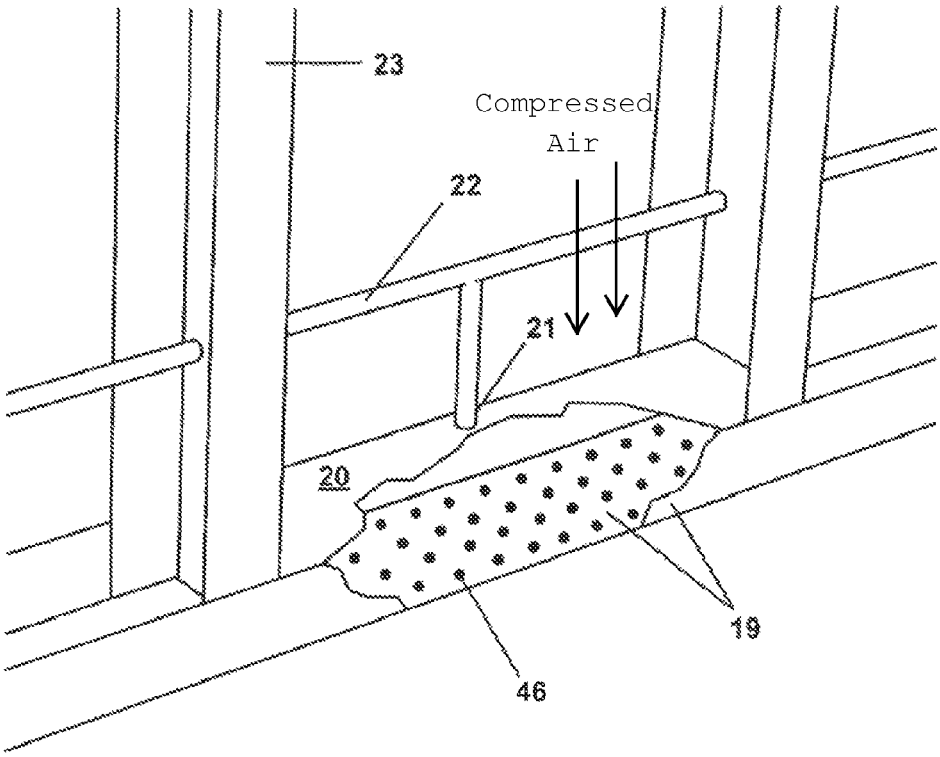
FIG. 8 is an illustration of the inside of a moveable wall section.

FIGS. 5, 6, and 7 show the structure after deployment from the shipping container. The Unit may sit on the pre-poured concrete foundation 15, in accordance with the local building jurisdiction and engineering specifications. The structure may be leveled using the integral floor leveling devices that will be discussed in FIGS. 12 and 13 and may be fastened to the foundation as detailed in FIG. 12 using Powers "power spike" fasteners. The hinged floor assembly 16 may be lowered to the foundation by unfastening moveable wall section 18 and carefully lowering it down to the foundation 15. After the hinged floor assembly is placed on the foundation 15, the hinges 17 may be removed by removing previously installed threaded fasteners. The hinged floor 16 may then be leveled using the integral floor leveling devices and may be fastened to the foundation using the Powers "power spike" fasteners detailed in FIG. 12. A compressed air source may be connected to airline 22 that is integrated into the moveable wall section 18. The moveable wall section 18 may be moved into position using the compressed air as a lubricant as seen in FIG. 8. Once in position, the moveable wall section 18 may be fastened to the hinged floor assembly.

FIG. 8 illustrates the integral wall bearing which may include the standard sill plate and channel 46, with a series of, in one embodiment, ⅛" holes 19 that are drilled in a 3"×12" grid ¼" on center. Then, a steel cover plate and box 20 that is approximately 3¼"×13"×1" tall with an open bottom may be welded and epoxied directly above the holes. The integrated wall bearing also may include an air inlet 21 connected to the cover plate box and an attached air source line 22 that provides compressed air through the moveable wall section 18. For example, the air source line 22 may be routed to the next location (approximately 4' on center) through the steel studs 23, and may be connected to an identical section of the sill 18 by means of a T fitting.

Illustrative Hinge Action

Figure 9:
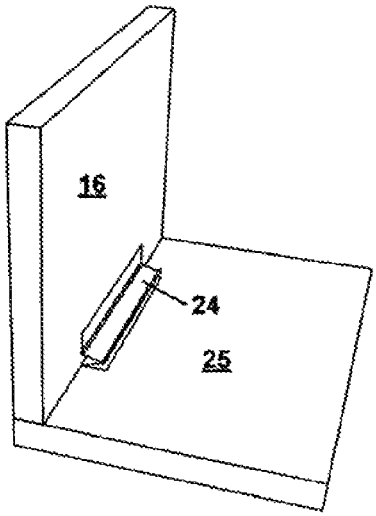
FIG. 9 is an illustration of a floor hinge with foldable floor section folded up.
Figure 10:
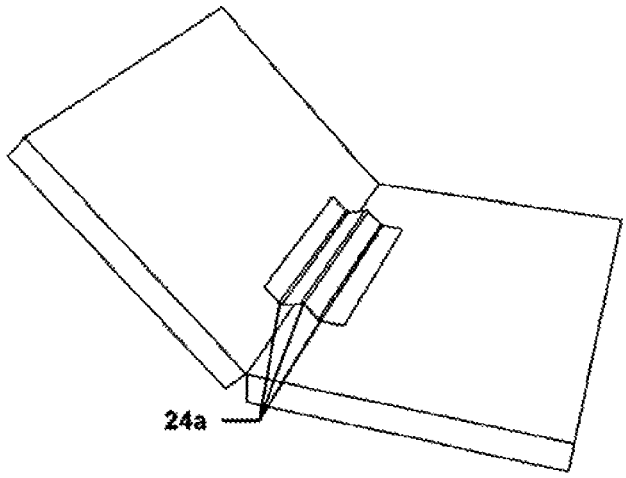
FIG. 10 is an illustration of a floor hinge with foldable floor being folded down.
Figure 11:
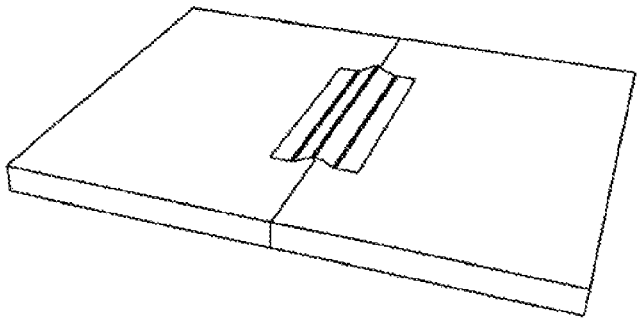
FIG. 11 is an illustration of a floor hinge with foldable floor folded down.

FIGS. 9-11 illustrate the "action" of the hinge 24. The hinge 24 consists of 4 pieces of punched steel and hinge pins 24*a* and may be configured to enable the hinged floor 16 to fold up perpendicular to the main framing and also to slide into the structure and sit squarely upon frame/floor section 25. This configuration, thus, provides for loading of the shipping container without any obstructions.

Illustrative Framework

Figure 12:
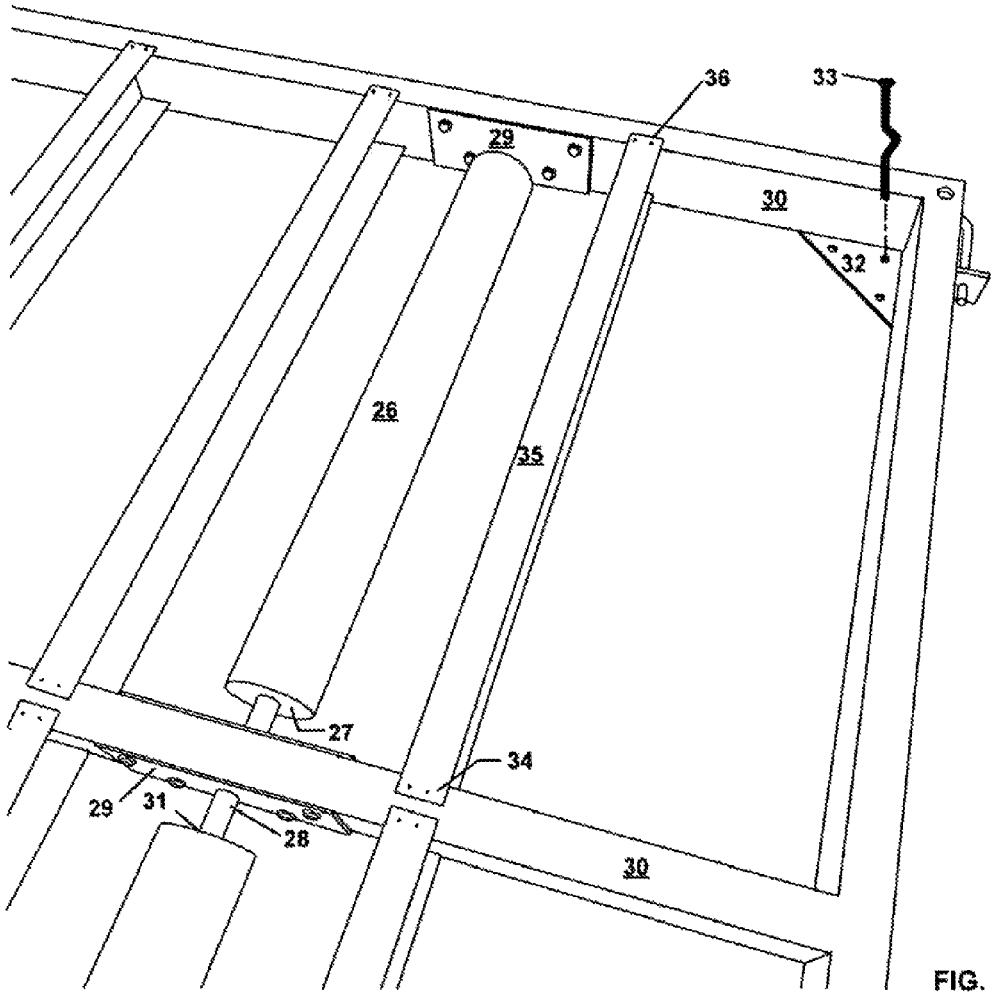
FIG. 12 is an illustration of rollers & tie down devices.

FIG. 12 illustrates the frame 9 in greater detail. The frame 9 may include a square tube frame assembly 30 with "c" channel floor joists 35. A steel roller 26 and roller bearing assembly 27, fitted in each end of the roller, may be attached to the square frame assembly 30 using the axle 28 and axle plate 29. A spacer 31 may center the steel roller 26 on the axle 28. The axle assembly may be mounted to project slightly below the frame to facilitate easy and relatively effortless loading and unloading of the unit from the shipping container. The frame 9 may also include a tie down device 32, consisting of a strategically drilled steel plate containing the requisite amount of holes to precipitate the Power spike 33 installation. The "c" channel floor joist 35, is also shown with a preformed tab 34, and a welding rivet 36 attaching the floor joist 35 to the square tube frame 30.

Illustrative Cam Lock Device

Figure 13:
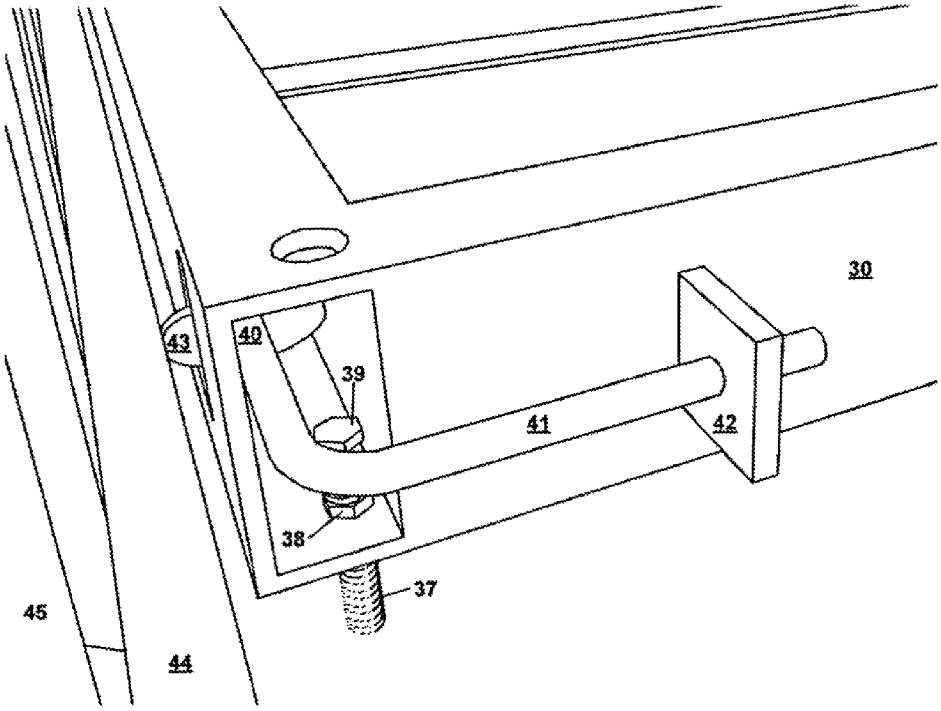
FIG. 13 is an illustration of an integral cam lock and integral floor leveling device.

FIG. 13 has the integral floor-leveling device 37 which, in one embodiment, may be installed in the square tube frame 30 approximately 60" on center longitudinally down each tube. The device consists of a nut 38 welded to the bottom of the square tube assembly 30, a threaded bolt 39 that is screwed into the nut 38, and an access hole in the steel tube frame directly above the welded nut 38. Once the frame 30 is in the final assembly position on the concrete foundation 15, the threaded bolt 39 may be adjusted utilizing a standard socket wrench and standard carpenter's level. Also shown in FIG. 13 is the integral cam lock 40 which may include steel rod 41, locking assembly 42, and the oblong cam 43. Once the structure is loaded in the standard shipping container the steel rod 41 may be rotated, which turns the oblong cam 43 into the shipping position. The oblong cam 43 bears on the inside of frame 30 as well as the wooden guide plate 44 that is positioned between the cam 43 and the container wall 45. The oblong cam 43 secures the structure during shipment from unnecessary movement. Once the Unit is on site, the locking assembly 42 is unlocked, and handle 41 is rotated up to release the oblong cam 43.

Illustrative Unit Construction

Figure 14:
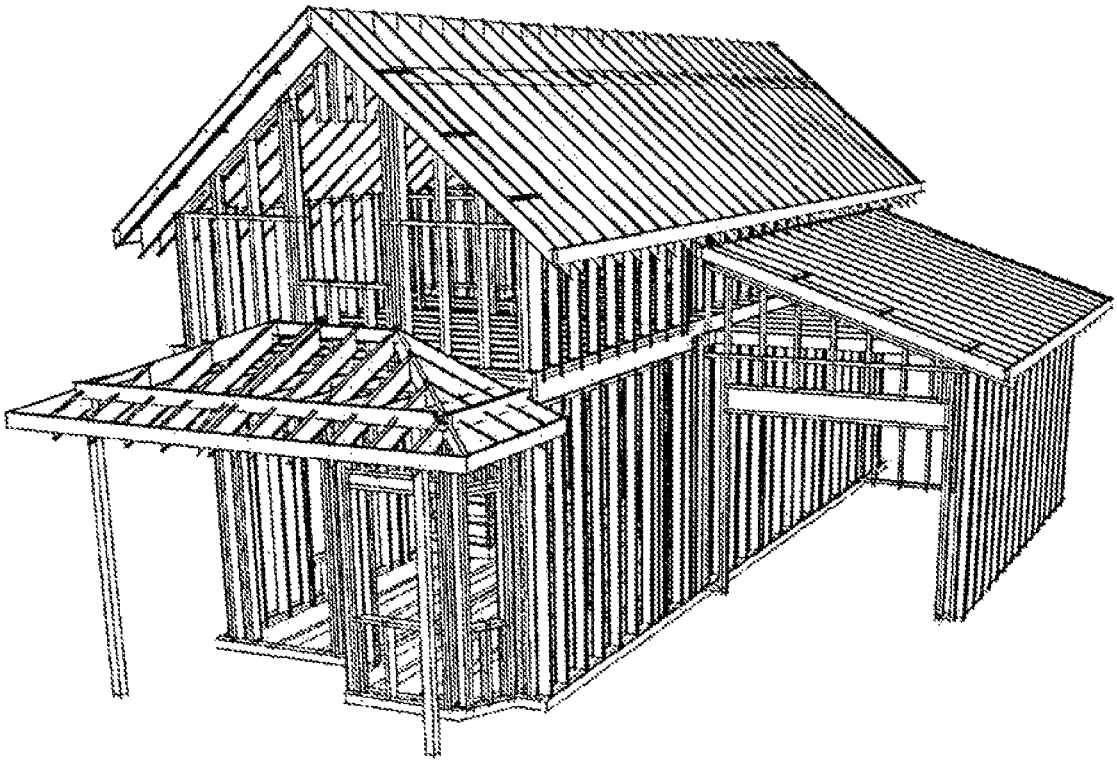
FIG. 14 is an illustration of framing inside an assembled Unit.

FIG. 14 depicts the steel framing of the Unit structure, with siding, insulations, and wall board removed for clarity. Once the moveable wall section 18 is affixed to the foundation the $2^{nd}$ story of the Unit (in certain embodiments having two levels) is deployed. Pressure treated plywood decking or similar materials may be attached to the Unit floor using threaded attachment fasteners prior to installation of interior partition walls and related doors. The porch as well as the garage may be similarly deployed. The following describes the relatively small amount of finishing that may be used to complete the substantially pre-built Unit. The finishing materials may include ceiling insulation, vapor barrier, and steel roofing which are easily attached using supplied threaded fasteners. Electrical wiring is uncoiled and extended from the junction boxes located on the first floor fixed walls to the appropriate electrical junction box on the second floor. Supplied finishing materials may be applied and final paint may also be applied. On-site plumbing and electrical services may be connected through an access panel in the bathroom floor. Supplied cement based backer board may be applied to the pressure treated plywood flooring and ceramic tile may be installed throughout the structure. The exterior siding and decorative trim may be finished and coated with the included "stucco" coating and any decorative rock or stone (if applicable is attached. Lighting fixtures may be attached to pre-installed electrical pig tales. The rollup garage door may also be installed and the structure is ready for final inspection and occupancy.

Figure 15:
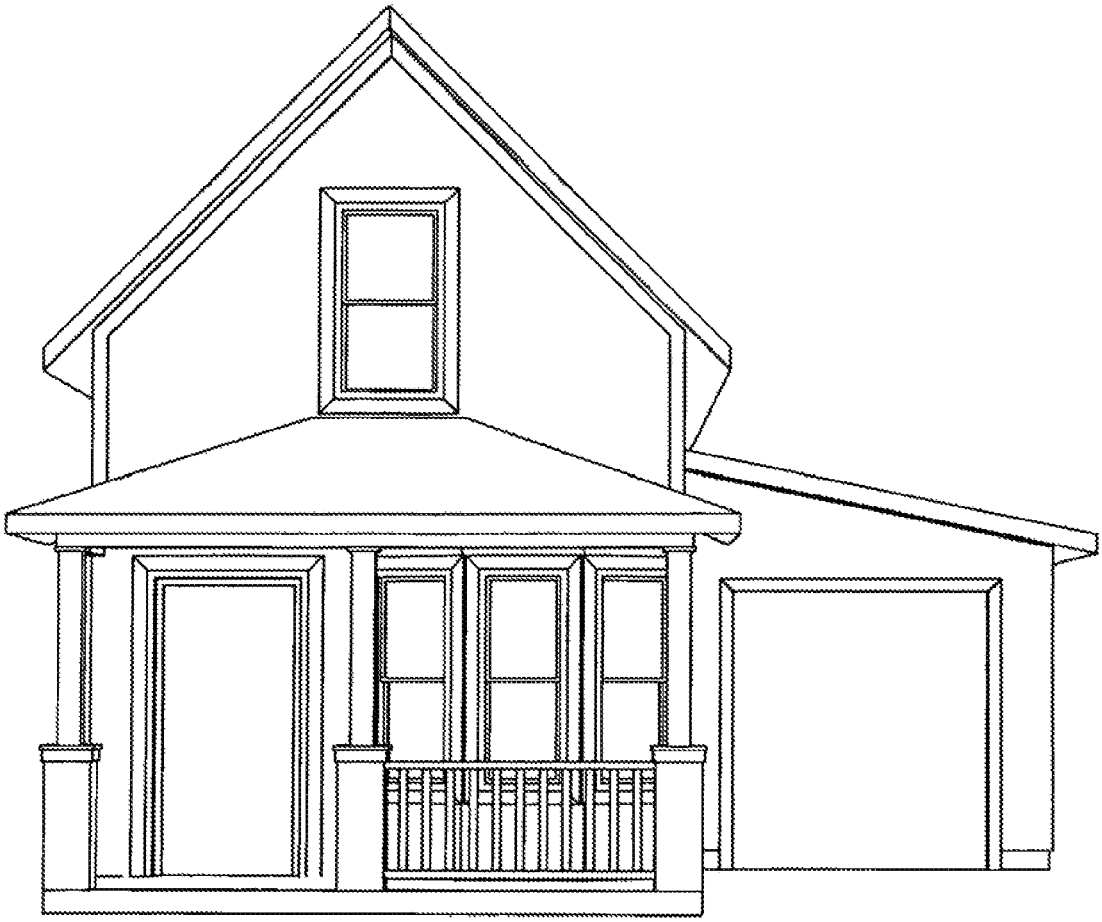
FIG. 15 is an illustration of a front view of an assembled Unit.

FIG. 15 shows some examples of the finished product that may be stored in one container including two story house designs that may expand out of a single container.

Alternative embodiments may also include an air-bearing wall system and panelized components for the home.

Conclusion

Although embodiments have been described in language specific to structural features and/or methodological acts, it is to be understood that the embodiments are not necessarily limited to the specific features or acts described. Rather, the specific features and acts are disclosed as illustrative forms of implementing the embodiments. For example, while embodiments are described having certain shapes, sizes, and configurations, these shapes, sizes, and configurations are merely illustrative.

What is claimed is:

1. An apparatus comprising:

a first structure that includes a first floor section and a first wall section for a prefabricated building;

a second structure that includes a second wall section for the prefabricated building, the second structure being separate and unconnected from the first structure, and when combined together the first structure and the second structure form exterior walls defining an exterior perimeter and interior walls of the prefabricated building; and a flooring structure that provides a second floor section for the prefabricated building, the first floor section and the second floor section provide a floor for an interior of the prefabricated building;

wherein the first structure, the second structure, and the flooring structure are disposed in a nested structure formed by nesting the flooring structure and the second structure within the first structure for transport of the apparatus, and wherein the second structure includes an air bearing along a base of the second structure, the air bearing being configured to receive compressed air and to provide an air cushion between the first structure and the second structure to enable the second structure to transition from the nested structure.

2. The apparatus of claim 1, further comprising a framing structure that includes a friction reduction assembly, the framing structure being connected to the bottom of the first structure to enable the apparatus to be moved when the apparatus is formed into the nested structure.

3. The apparatus of claim 1, further comprising a standard shipping container, the nested structure being disposed inside the shipping container.

4. The apparatus of claim 3, wherein the standard shipping container includes a high cube configuration.

5. The apparatus of claim 3, wherein the first structure includes a cam lock mechanism configured to secure the first structure to the shipping container.

6. The apparatus of claim 1, wherein the first wall section is at least about 96 inches tall.

7. The apparatus of claim 1, further comprising a plurality of finishing materials for the prefabricated building disposed within a plurality of open spaces in the nested structure.

8. The apparatus of claim 1, wherein the second structure includes a plurality of rollers along a base of the second structure, the rollers being configured to enable the second structure to move out from a nested position within the first structure.

9. An apparatus comprising:

a structure for a prefabricated building including exterior walls, interior walls, and a floor, the structure configured to transition from a collapsed state to an expanded state, in the collapsed state, the structure has a first width, in the expanded state, the structure has a second width that is greater than the first width;

the structure including:

at least two prefabricated sections which are separate and unconnected from each other in the collapsed state, and when combined together the at least two prefabricated sections form exterior walls and interior walls of the prefabricated building when the structure is in the expanded state, and at least one of the prefabricated sections includes:

a portion of a floor for the prefabricated building;

a plurality of prefabricated utility connections for the prefabricated building; and an air bearing along a base of the at least one prefabricated section, the air bearing being configured to receive compressed air and to provide an air cushion to enable the at least one prefabricated section to transition from the collapsed state to the expanded state.

10. The apparatus of claim 9, wherein one of the at least two prefabricated sections further includes a plurality of bathroom fixtures.

11. The apparatus of claim 10, wherein the bathroom fixtures include a bathtub, toilet, and vanity.

12. The apparatus of claim 9, wherein one of the at least two prefabricated sections further includes a plurality of kitchen fixtures.

13. The apparatus of claim 12, wherein the kitchen fixtures include a cabinet, a sink, and a cooking appliance.

14. The apparatus of claim 12, wherein the one of the at least two prefabricated sections further includes a water heater.

15. The apparatus of claim 9, wherein one of the at least two prefabricated sections further includes a stair case that provides access to a second level of the prefabricated building.

16. The apparatus of claim 9, wherein the portion of the floor for the prefabricated building is connected to the at least one prefabricated section with a hinge, the hinge being configured to:

enable the portion of the floor to fold up perpendicular to the at least one prefabricated section, and to slide into and sit squarely on a portion of the at least one prefabricated section.

17. An apparatus comprising:

a fixed wall portion of a prefabricated building, the fixed wall portion includes a vertical wall section and a horizontal flooring section for the prefabricated building;

a moveable wall portion for the prefabricated building, the moveable wall portion includes a vertical wall section and is nested within the fixed wall portion, the moveable wall portion is separate from and not connected to the fixed wall portion, and is capable of being moved out of the fixed wall portion and connected with the vertical wall section of the fixed wall portion, when connected the fixed wall portion and moveable wall portion form a base perimeter of the prefabricated building; and a moveable floor portion for the prefabricated building, the moveable floor portion is nested within the fixed wall portion and is capable of being moved out of the fixed wall portion and connected to the horizontal flooring section of the fixed wall portion and the vertical wall section of the moveable wall portion, wherein the movable wall portion includes an air bearing along a base of the movable wall portion, the air bearing being configured to receive compressed air and to provide an air cushion to enable the movable wall portion to be moved out of the fixed wall portion.

18. The apparatus of claim 17, wherein the fixed wall portion is at least about 96 inches tall.

19. The apparatus of claim 17, wherein the vertical wall section of the fixed wall portion and the vertical wall section of the moveable wall portion both include an interior surface and an exterior surface, the interior surface comprising wall board.

20. The apparatus of claim 19, wherein the vertical wall section of the fixed wall portion and the vertical wall section of the moveable wall portion both further include insulation between the interior surface and the exterior surface.

21. A method comprising:

extending a moveable floor portion from a nested position in a fixed wall portion to a position adjacent to the fixed wall portion, the fixed wall portion includes a vertical wall section and a horizontal flooring section for a prefabricated building;

moving a moveable wall portion from the nested position within the fixed wall portion to a position adjacent to an edge of the moveable floor portion and adjacent to the fixed wall portion, the movable wall portion being separate from and not connected to the fixed wall portion during the moving; and connecting the moveable wall portion to the fixed wall portion to form a base perimeter for the prefabricated building, the prefabricated building has a width that is greater than a width of the fixed wall portion, wherein moving the moveable wall portion from the nested position includes pressurizing an air bearing within the moveable wall portion, the air bearing being located along a base of the moveable wall portion.

22. The method of claim 21, further comprising, prior to extending the movable floor, removing the prefabricated building from a standard shipping container.

23. The method of claim 21, further comprising anchoring the fixed wall portion and the moveable wall portion to a foundation for the prefabricated building, the fixed wall portion being at least about 96 inches tall.

* * * * *